United States Patent [19]

Winner et al.

[11] 4,259,813

[45] Apr. 7, 1981

[54] PLASTIC WINDOW

[76] Inventors: Kurt W. Winner, 22 Fairmount Ave., Mahwah, N.J. 07430; Ignazio Cangialosi, 756 Rifle Camp Rd., West Paterson, N.J. 07424

[21] Appl. No.: 2,232

[22] Filed: Jan. 9, 1979

[51] Int. Cl.[3] ..... E06B 1/04

[52] U.S. Cl. ..... 49/504; 49/380

[58] Field of Search ..... 49/504, 380, 63, 61, 49/501; 160/90, 91

[56] References Cited

U.S. PATENT DOCUMENTS

| | | | |
|---|---|---|---|
| 3,587,705 | 6/1971 | Zappone | 160/91 |
| 3,859,754 | 1/1975 | Budich et al. | 49/504 X |
| 3,959,926 | 6/1976 | Noecker et al. | 49/504 X |

*Primary Examiner*—Philip C. Kannan

*Attorney, Agent, or Firm*—Ostrolenk, Faber, Gerb & Soffen

[57] ABSTRACT

A window frame of extruded material having vertical members including sash guides wherein the vertical members are identical but reversed with respect to each other and in mirror-image relation; the sill and header are identical but inverted and reversed end for end with respect to each other. Each frame may be constructed of an identical pair each of two different members. The sill slopes downwardly toward the exterior of the frame. The sill and header are notched at right angles to the outer and inner surfaces to form corner seams which carry out the horizontal lines of the window frame and which do not require exact and difficult mitering to obtain a perfect seam. Such joints do not open during shipping and handling as do miter joints. The sash frame elements are made from a third extrusion. The vertical members and the sill and header are provided with sash supports in which the outer sash edge rides against an end wall of a vertical channel which faces into the window. The inner sash rides against the side of the same channel wall thereby bringing the sashes close together. The header and sill each have a horizontal channel; the sill channel matches the end of the vertical channel wall against which the upper and outer sash rides and the side of the vertical channel against which the inner and lower sash rides to provide means for weather exclusion.

8 Claims, 9 Drawing Figures

FIG. 6
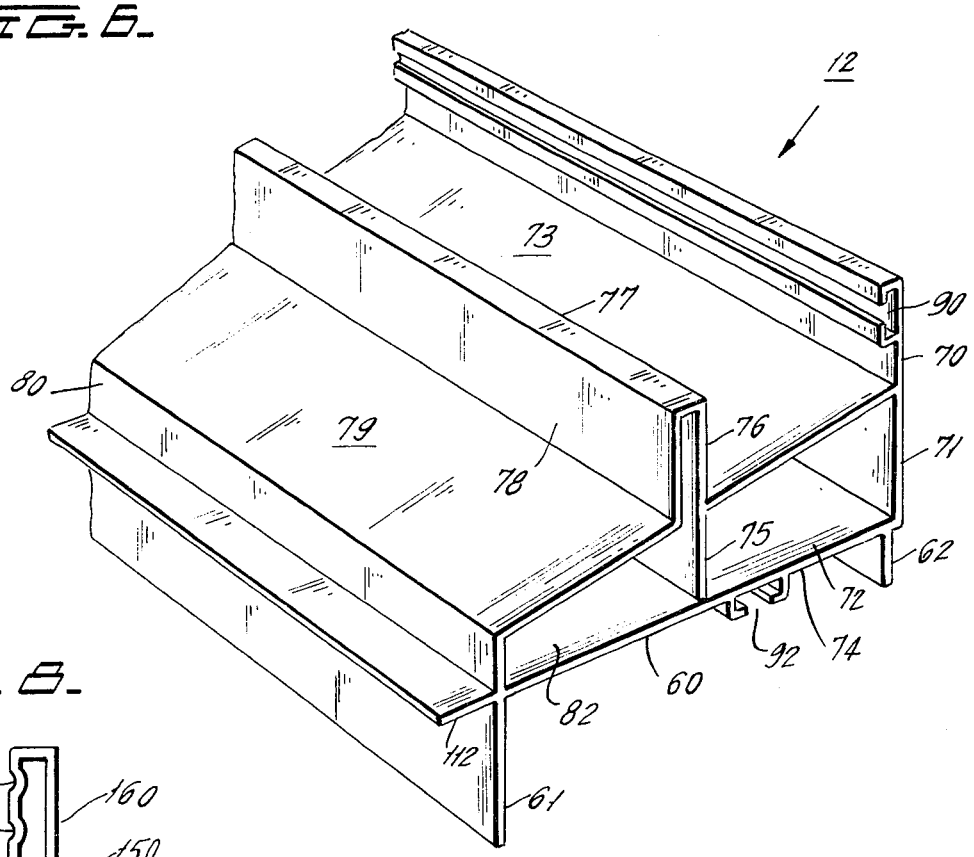
FIG. 8
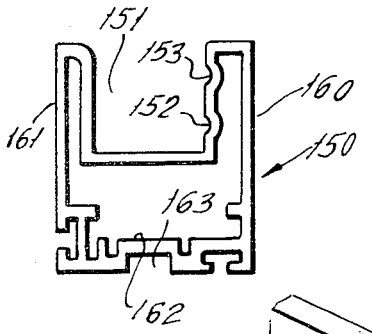
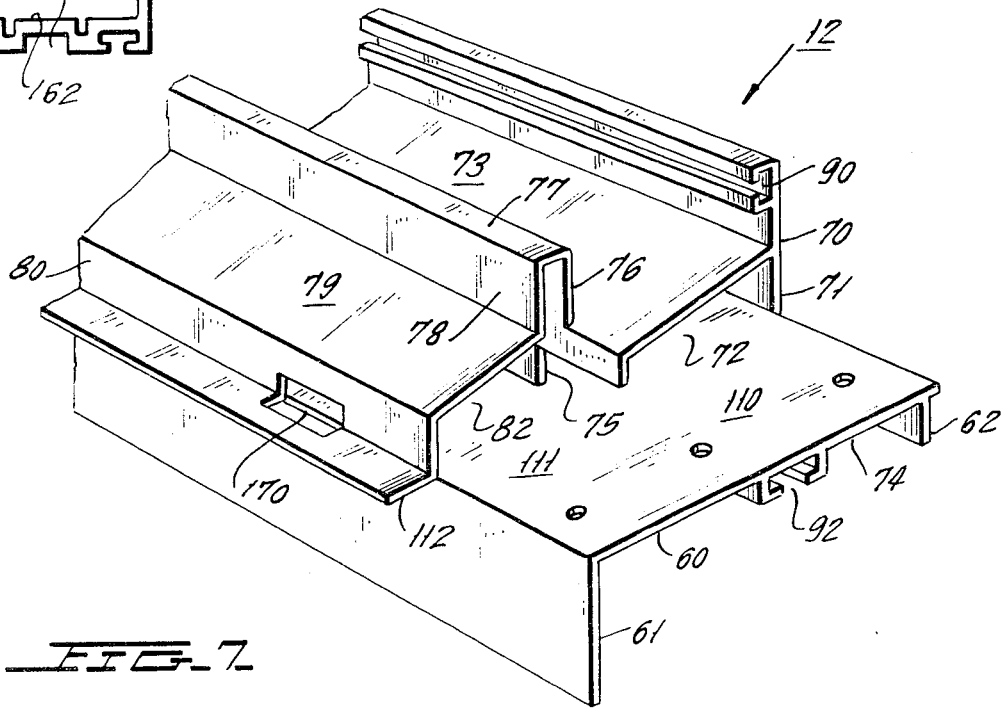
FIG. 7

PLASTIC WINDOW

The present invention relates to window frames and more particularly to a window frame which may be preassembled for installation in a building and which entails a minimum number of different parts which may be notched, inverted or otherwise arranged so that they match each other.

Essentially the present invention comprises a window frame made of two basic parts, the vertical section and the horizontal section. The sill and the top header are identical; they are reversed with respect to each other. The two vertical sections also are identical and reversed in mirror-image fashion with respect to each other.

The window frame as a whole is delivered to the site but has been assembled from a single pair of identical but reversed vertical members and a single pair of identical but inverted horizontal members.

A principal object of the present invention is the arrangement of the transverse members, that is the sill and the header at, respectively, the bottom and top of the window frame so that, when installed in an opening having horizontally level surfaces and vertical members exactly perpendicular thereto, the lower section, the sill, will slope downwardly toward the outside of the building providing automatic drainage for any moisture which may condense or otherwise occur at the window frame and the upper section will correspondingly slope upwardly toward the inside of the window frame.

Another object of the present invention is the construction of a window frame which may be extruded and made of plastic or other low thermally conductive extrudable material, wherein a single extrusion may be used for the left and right vertical sections of the window frame, the same elements being reversed with respect to each other; and a single extrusion may be used for the horizontal sections of the window frame, the elements being inverted with respect to each other.

A further object of the present invention is, in the formation of an extruded window frame consisting of two basic elements as above mentioned, the arrangement of the extrusion to provide a series of substantially rectangular cross-sections in order to provide appropriate reinforcement of the vertical and horizontal members as well as appropriate guide means in the frame for the sashes which may be used and appropriate insulation owing to the existence of the dead air spaces formed by the hollow sections of the essentially rectangular cross-section members.

Another and important object of the present invention is the arrangement of the window frame sections so that the utilization of a simple notching arrangement preferably utilized on the bottom and top sills will avoid the need for accurate miter joints and provide a perfect seam or bond between vertical and horizontal elements so that extreme accuracy in the cutting and assembly of the joints will not be needed and so that the elements will go together automatically and thus may be assembled by relatively unskilled personnel. The butt type joint will not open up like a miter joint during shipping, handling and installation.

A further object of the present invention is the arrangement of the vertical member so that a vertical guide between the sashes provides a surface to surface seal for the outer sash and an edge to edge seal for the inner sash so that the sashes may each be readily weather sealed and yet may ride close to each other to permit full weather sealing when closed. This applies also to the divider in the sill and header which are asymmetrically located with respect to each other. The divider in the header meets and forms a continuous rectangular frame with the vertical guides at the top; the same divider in the sill is, by reason of its asymmetric location, displaced outwardly to permit the inner surface of the sash to butt against the sill.

The foregoing and many other objects of the present invention will become apparent in the following description and drawings in which.

Figure 1:
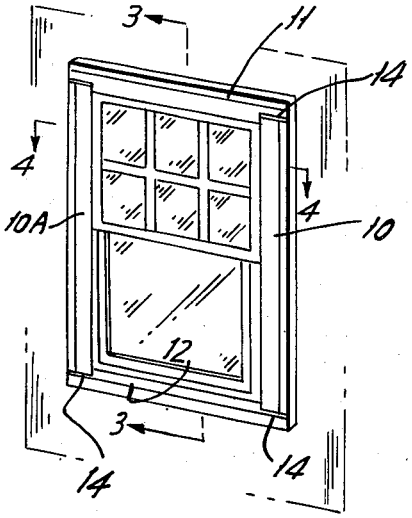
FIG. 1 is a view of the novel window frame of the present invention taken from the outside of the structure.
Figure 4:
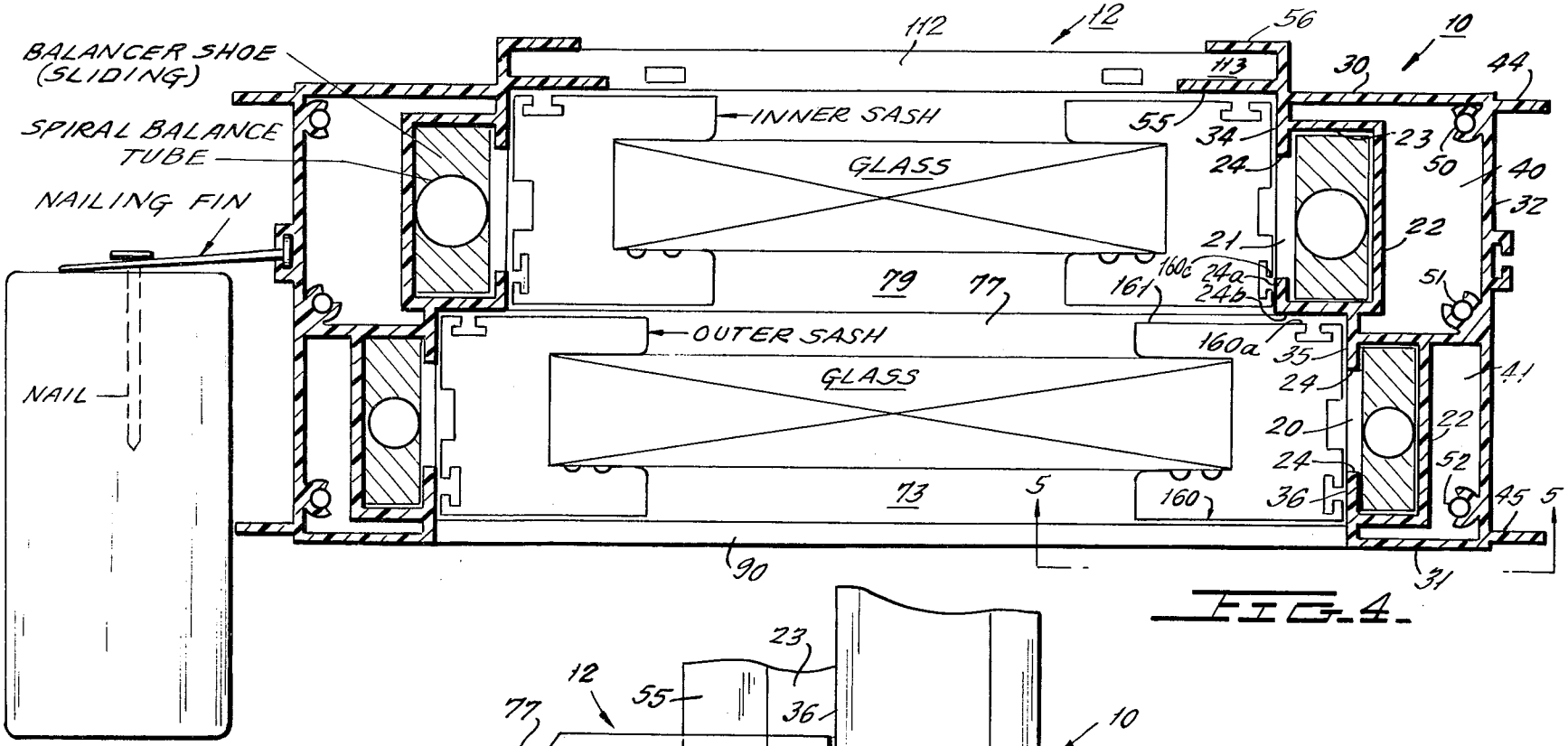
Figure 5:
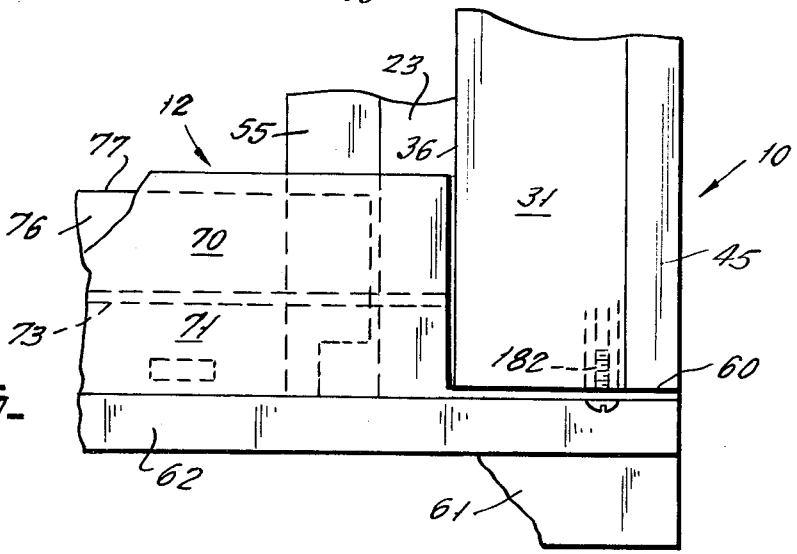

FIG. 4 is a cross-sectional view taken from line 4—4 of FIG. 1 looking in the direction of the arrows and rotated 180 degrees FIG. 5 is a partial elevation of the interior of the window frame taken from line 5—5 of FIG. 4 looking in the direction of the arrows.

FIG. 6 is a view in perspective of the horizontal member of the window frame as first extruded.

FIG. 7 is a view in perspective corresponding to that of FIG. 6 showing the horizontal member of FIG. 6 appropriately notched as a sill in order to match exactly with a vertical member.

FIG. *7a* is a view in perspective corresponding to that of FIG. 6 (and FIG. 7) showing the horizontal member of FIG. 6 appropriately notched as a header in order to match exactly with the vertical members.

FIG. 8 is a cross-sectional view of one form which the sash may take showing a vertical section through a vertical support of the sash.

Figure 2:
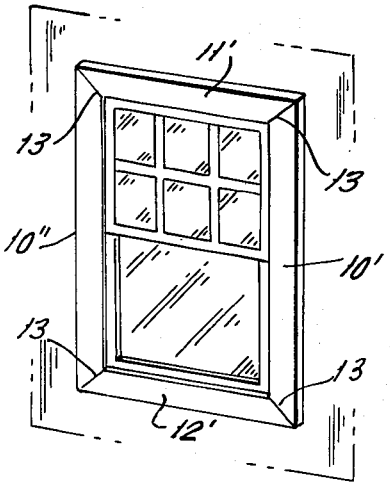
FIG. 2 (PRIOR ART)
FIG. 2 is a view corresponding to that of FIG. 1, but showing a prior art type of construction.

Referring now to the Figures, FIG. 2 shows the prior art construction in which two vertical members 10', 10'' of the frame are connected to the horizontal members 11', 12' of the frame by mitered joints 13. The need for utilizing the mitered joints 13, particularly in connection with extruded preformed sections is one of the elements which the structure of this invention makes unnecessary.

As shown in FIG. 1 the vertical frame 10 and the vertical frame **10*a* are connected to the horizontal sill 12 and the horizontal header 11 by joints 14** at the top and bottom which are not mitered and which present a smooth continuous even appearance contributing to the ornamental aspect of both the interior and exterior of the window; this is especially so since the horizontal lines of the joint carry out the horizontal pattern of the window frame itself and do not introduce diagonal lines which, as closely as they may be joined, nevertheless introduce a clashing design.

Figure 3:
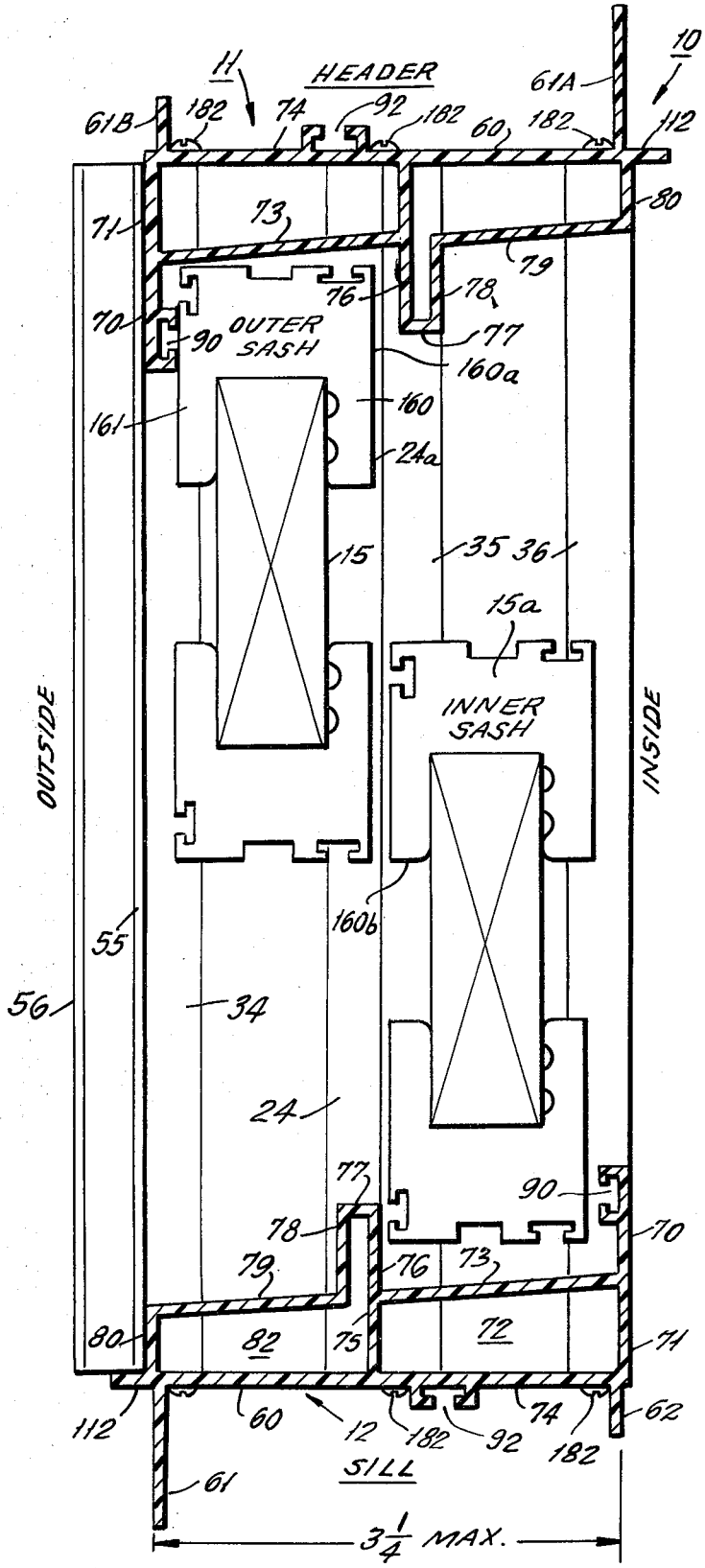
FIG. 3 is a cross-sectional view taken from line 3—3 of FIG. 1 looking in the direction of the arrows.

FIGS. 3, 4 and 5 show the vertical members 10 and **10*a*. Each vertical member comprises a counter balance section 20 for the inner sash and a counter balance section 21 for the outer sash. Sections 20 and 21 are preferably as noted extruded as a part of the entire member 10. Each section 20 and 21 comprises a base vertical section 22, vertical wall sections 23, 23 and vertical flanges 24, 24 which in cross section form a substantially rectangular structure providing a recess for the counter balance means which may be used as well as any guide shoe which may be used. The same reference numbers have been applied to the various walls of the slide 21** as to the slide 20 because they operate in the same manner. The upper sash 15 and lower sash 15*a* hereinafter described may be arranged so that they each have vertical sections 160–161, (FIGS. 3 and 8) guided by the end 24*a* and outer surface 23*a* of the channel wall. The pane may extend from elements 160–161 of FIG. 8 to form the visible portion of the sash itself.

The asymmetrical arrangement of the vertical members permits section 160*a* of the lower sash to abut along its vertical edge against the surface 24*b* of the vertical flange 24*a* on each side of the window; thus appropriate weather sealing may be placed between the side of the lower sash and the surface 24*b* of vertical member 24*a*. With respect to the upper sash, surface 160*c* of the upper sash abuts against the surface 24*a* of the vertical member. Thus, the side of the upper sash which abuts against the surface 24*a* may be provided with an appropriate weather excluding surface or the wall 24*a* may be so provided, or both. The arrangement of the horizontal frame sections, the sill and header to complete this weather-exclusion is hereinafter described.

The vertical member 10 includes, in addition, the principal vertical wall 30 which extends at the front surface of the frame. The front of the frame here is referred to as that portion of the frame which extends on the front of the building and is not visible from the interior of the building. An opposite vertical wall 31 extends parallel to the wall 30 and extends on the interior side of the frame. The front and inside vertical walls 30, 31 are connected by the vertical wall 32. Further interconnection and reinforcement of the entire vertical structure 10 is achieved by the additional vertical wall 34, the additional vertical wall 35 and the additional vertical wall 36. Wall 34 extends between wall 30 and the vertical side 23 of the outer sash slide. Vertical wall 36 extends between the interior wall 31 and the inner wall 23 of the interior sash slide and vertical wall 35 interconnects the two sash slides 20 and 21 so that an entire integrated self-supporting, self-reinforcing structure is defined.

The hollow sections 40 and 41 between the wall 32 and the two slide sections 20 and 21 fill out the vertical frame 10 so that it is of the appropriate dimension and also provides dead air space insulation where such dead air space insulation may be required or desired.

The support 10 also has a further extension 44 at the front substantially parallel to the wall 30; said extension 44 provides means for further integrating the frame with the building structure as required. The wall 31 has a similar extension 45 which is substantially parallel to the wall but inset with respect thereto in order to provide further for completion of integration of the structure with the building wall. Under appropriate circumstances the extensions 44, 45 may be removed where they are not required.

In addition, the wall 32 is provided with three integral tubular extrusions 50, 51, 52 of an appropriate diameter to receive a screw at any point at which the extrusion of support 10 is cut so that when a screw is inserted through a hole in the sill and header sections as hereinafter described, an appropriate means for receiving the screw, which in this case would be a self tapping screw, will be provided.

In other words, the vertical member 10 may be extruded to any desired length either required for window frames of particular size or to the maximum length permitted by the size of the structure within which the extrusion device is housed and may then be cut to desired lengths prior to manufacture of the window frame.

Each vertical member 10 is provided with an additional extension 55 extending in a plane toward the window and an outer flange 56 parallel to the additional flange 55. The flanges 55 and 56 may form a channel to receive either a storm window or screen which may be so arranged that it may readily be slid in or out of the channel as required.

The vertical member 10*a* is constructed identically to vertical member 10. It will be noted that the vertical member 10 is so arranged that the outer sash slide 21 extends further into the frame than the inner sash slide 20. The difference between the vertical frame member 10 and the vertical frame member 10*a* is that the member 10*a* is inverted with respect to the member 10. In this way a single extrusion may be used both for the vertical members 10 and the vertical members 10*a*.

Since the fastening devices used to complete the window are preferably self-tapping screws extending into the tubular members 50, 51, 52 and since the tubular members extend the full length of the wall 32, the members may be cut at any point transversely and still be complete members capable of being connected to the sill at the bottom and the header at the top.

The interior surface portions of the support member shown in FIG. 4 are seen in the partial elevational view of FIG. 5 and the same reference numbers have been applied to those parts which are visible.

The horizontal members which form the header 11 and the sill 12 of the window frame are shown in FIGS. 3, 6 and 7 and partially in dotted line form in FIG. 5. A portion of the support member 10 appears also in FIG. 3 and reference numbers have been given thereto corresponding to the reference numbers in FIG. 4.

It should be borne in mind that the top and bottom sections are identical extrusions formed in the same way except that they are inverted and reversed with respect to each other. The bottom sill comprises a base wall 60 having flanges 61 for the exterior and 62 for the interior extending downwardly. The flanges 61, 62 cooperate with the vertical flanges 44, 45 of FIG. 4 to provide appropriate extensions in order to assist in integrating the completed window frame with the structure in which it is built. The upper member 11 has identical structure to effect the same result.

The interior end of the sill 12 is provided with the vertical wall 70 which extends across the bottom of the window frame at the interior. Vertical wall 70 extends above the wall 71 which is one of the walls defining the extruded section 72 having the sloped wall 73, the bottom wall 74 and the vertical wall 75. The wall 73 provides a base against which the inner sash may come to rest. The sash in this case rides in the sash guideway previously referred to in connection with FIG. 4. The sloping horizontal wall 73 is connected to the vertical wall 76 which is a vertical upward extension of the wall 75 which in turn is connected to the short horizontal spacer wall 77 and then to the vertical wall 78, parallel to the wall 76, and then to the sloping horizontal wall 79 and the vertical wall 80. Section 75, the sloping wall 79 and the vertical wall 80 define a hollow transverse section 82, the top wall of which is the sloping wall 79. When the member 11 is used as a header as in FIG. 3, member 79 simply acts as one of the supports for member 77 which limits upward movement of the lower or inner sash. Similarly, when member 12 is used as a sill in FIG. 3, then the sloping walls 73 and 79 provide a support for member 77 which limits the downward movement of the upper or outer sash.

In addition to the weather sealing obtained by the meeting of surfaces 160*a* of the lower sash and 24*b* of the vertical member, and the meeting of surfaces 160*c* of the upper sash and 24*a* of the vertical member, additional weather exclusion is provided by engagement of the outer surfaces of the outer sash with members 55 and 34 of the vertical members and by similar engagement of corresponding surfaces of the lower sash with sections 36 of the vertical members.

Thus the upper window sash is completely sealed on three sides when it is closed to the header and the bottom sash is completely sealed on three sides when it is closed to the sill. The sashes are spaced sufficiently close to each other that appropriate weather stripping at the upper end of the bottom sash, may form a complete weather excluding seal for the window when it is fully closed.

The vertical inner wall 70 of sill 12 and of header 11 each terminate in the channels 90 directed toward the sash slide. Channel 90 furnishes an appropriate reinforced finishing for the surface wall 70 of the window frame. The channel 90 may also be used for weather excluding material which it may be desired to secure therein in order to eliminate any possibility of drafts when the window is closed.

The lower wall 60 may also be provided with the extruded channel 92 into which a nailing fin (FIG. 4) is slid. This provides a means of nailing the window to the face of the rough opening in new home construction.

One of the essential elements which should be noted is that the walls 73, 79 of the lower section 12 slope toward the outside of the building so that any moisture which may form or be condensed in the structure may readily flow toward the outside of the building rather than toward the inside of the building. Water condensed at surface 73 may flow outwardly and laterally toward each vertical channel and drain therethrough. The structure of the sill 12 and of the header 11, shown more particularly in FIGS. 6 and 7, are made from extrusions.

The sill 12 as seen in FIG. 6 and the header 11 are initially cut to the desired length in the form shown in FIG. 6. Thereafter the section of the sill from and including the wall 71, to and including the walls 75 and 76 are notched or cut so that the section 110 is provided. The header member of FIG. 7*a* is correspondingly notched but in reverse as shown in FIG. 7*a* and as described.

The initial cutback is to provide an appropriate space for the slideway section 20 and the hollow section 41 of the vertical member 10 of FIG. 4. An identical notch is made on the other side to provide a space to receive the inverted vertical frame member on the other side. An additional notch 111 is cut in the walls 76, 78 the lower portion of wall 75 and the wall 80 as well as the screen supporting extension 112 hereinafter described in order to provide room for the outer hollow section 40 and outer sash slide 21.

Figure 7A:
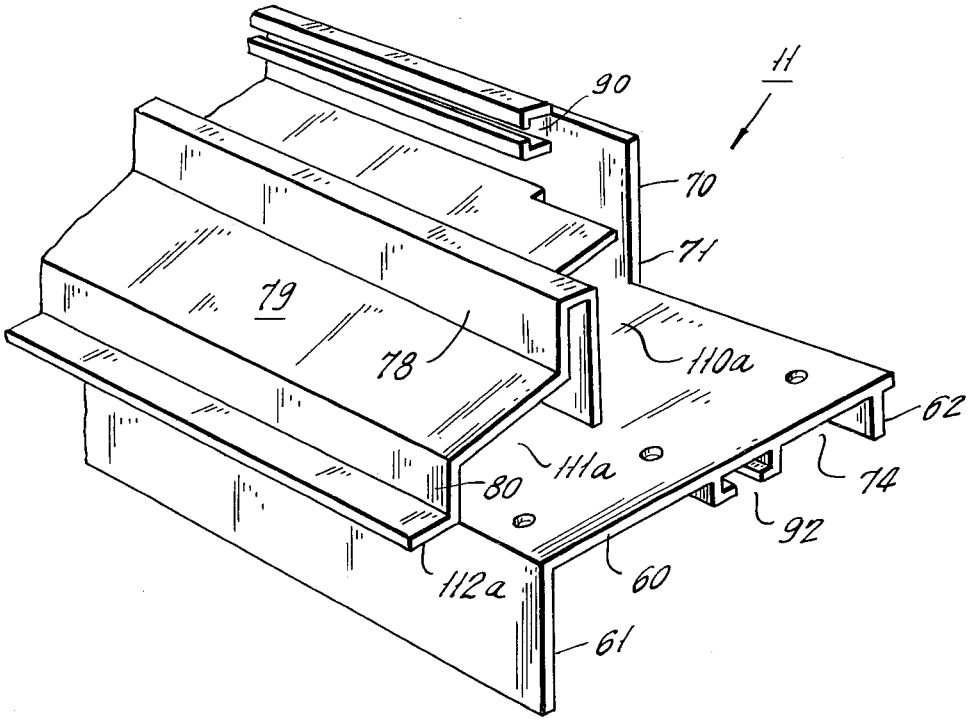

FIG. 7*a* shows a corresponding set of notches at 110*a*, 111*a* and 112*a* for the header. This corresponding set of notches for the header differs from the set of notches for the sill shown in FIG. 7 in that the notch 110*a* is deeper and the notch 111*a* is shallower while in both cases the notch 112*a* extends from the wall 80 at the level where the notch 111 in the case of FIG. 7 and notch 111*a* in the case of FIG. 7*a* is cut. This permits the frame to be completely formed with the vertical members connected to the sill and the header. Such formation is made at the factory so that the complete window frame may be shipped as an assembled completed unit ready for installation. The drainage holes 170 of the sill (FIG. 7) are not used in the structure shown in the header of FIG. 7*a*, and the channel 90 and the wall supporting the same is cut back to the header of FIG. 7*a* for a sufficient distance to permit engagement of the flange 55 of the vertical member with the header.

It should be pointed out that while the flange 112*a* is shown and described as cut back to the same extent as the notch 111*a*, actually, since the vertical member does not extend into that area the exact cutting back of the flange 112*a*, while useful, is not essential.

It will be noted here that all cuts are made at right angles and no miter joints are needed thereby ensuring a simplified fit of the parts without the need for excessive care or tooling or the use of complex tools.

If desired appropriate cement may be used at the assembly points and where a plastic extruded frame is utilized the cement may be one which is similar to the plastic frame and actually constitutes a weld between the vertical and the horizontal members.

The sill 12 after the elements have been notched to the form shown in FIG. 7 may then be provided with holes matching the extruded tubes 50, 51, 52 (FIG. 4) of the vertical members so that self-tapping screws 182 (FIG. 5) may be inserted from the underside of the wall 60 into the tubes 50, 51, 52. The header 11 is similarly notched and connected.

By this means, therefore, a simplified window frame structure is provided which may be readily assembled and which is made from two basic members. The vertical members are identical although they are reversed with respect to each other and the top and bottom horizontal members are identical although they are reversed and reverse notched with respect to each other. Actually, three extruded members are used: The frames of each sash, the top, bottom and side members may all be made from a single extrusion.

In FIG. 8 there is shown in highly schematic form one form which the sash utilized in connection with the window frame of the present invention may take. The sash 150 is also an extruded member having an open ended section (FIG. 8) in which a window pane may be fitted. The window pane may be of any desired thickness, may be a double or triple window pane with either air excluded or an inert transparent gas between the two sections of the double window and is appropriately supported by cement or otherwise in the section which receives the window pane. The type of sealant which may be used to effect appropriate bonding to glass may not necessarily bond completely and successfully to plastic. In order, therefore, to provide a mechanical lock as well as an adhesive lock between the window pane and the frame of the sash, the grooves 152, 153 are provided into which the sealant also flows and forms a rigidified molding or engagement which mechanically interlocks with the grooves 152 and 153. Therefore should the sealant to the plastic loosen in any area, the glass of the window pane may nevertheless remain stationary and positioned firmly within the sash by reason of the engagement of the solidified sealant with the grooves 152, 153.

As is well known, the closing of a sash involves grasping the nearest available portion of the sash or if a handle is provided, grasping the handle and pulling the sash down. However, in a horizontally long sash, the tendency may be especially in closing the sash, to simply press down on the nearest available point. In raising the sash it is usual to raise it from the center or utilize handles but if the sash is partly raised, then quite frequently the nearest available grasping point at the underside of the sash is engaged. The constant utilization of even the handles in addition to the other methods of operating the sash manually, result in the tendency to skew the sash. Since the window pane material is rigid while the plastic of the sash is somewhat resilient, the tendency in the case of the use of a sealant is, therefore, to result in some kind of a break in the sealant. However, by the utilization of cement in the first instance and the utilization of the retaining grooves 152, 153 in the sash appropriately arranged in an appropriate number, the mechanical interlock between the window pane and the sash retains the window pane in position in the sash despite repeated operation of the window which may result in the tendency to skew the sash frame.

The window pane support is provided with inner supports 160 and outer supports 161 communicating with the slide wall 162 which slides in the respective channels 20, 21, the window panes being, of course, of different size.

As before pointed out, the four sides of the window pane are made from an identical extrusion. In the case of a window pane which is other than square then the top and bottom are cut to different lengths than the sides. The groove 163 at the bottom of the window frame may be used for the support of window bars or for elements which engage the counterbalancing mechanism or for both (the window bar may also engage the counterbalancing mechanism); on the top the recess 162 may be utilized for appropriate location of hardware including for instance latches.

The section 60 of sill 12 is provided with the extension 112, above referred to, which may cooperate to support a screen or storm window supported in the slide 113 between the outer flanges 55, 56.

In the foregoing the present invention has been described in connection with preferred illustrative embodiments thereof. Since many variations and modifications of the present invention will now be obvious to those skilled in the art it is preferred that the scope of this invention be determined not by the specific disclosures herein contained but only by the appended claims.

What is claimed is:

1. A window frame comprising a pair of vertical members identical in cross-section but reversed and in mirror image with respect to each other and a pair of transverse top and bottom members forming, respectively, the header and sill; said top and bottom members being identical but inverted and reversed with respect to each other; said sill being provided with an upper wall which slopes transversely and downwardly toward the exterior of the window frame; said header having a lower wall which slopes upwardly toward the interior of the window frame and an upper outer sash and a lower inner sash.

2. The window frame of claim 1 in which said sill and said header each have a respective member extending into the window area, each of said members extending asymmetrically of said sill and header.

3. The window frame of claim 2 in which said sill further comprises an upward-facing channel and each of said vertical members comprises walls forming a respective channel extending into said window frame, and in which said channel of said sill coacts with said channels of said vertical members to form a continuous frame therewith; and said header further comprising a downward-facing channel which is displaced toward the interior of said window frame from said vertical channels.

4. The window frame of claim 3 wherein each of the upper and outer sash and the lower and inner sash engages with a complete sealing frame when closed.

5. The window frame of claim 2 wherein each of said vertical members comprises walls forming a respective channel extending into said window frame, and in which said sill and header each have a substantially horizontal wall spaced from said sloping walls and at the periphery of said window frame;

said horizontal walls extending across the ends of said vertical channels; and said window frame further comprising means for sealing said horizontal walls to said vertical walls.

6. The window frame of claim 1 in which said vertical members have opposite inner sash guideways integral therewith and opposite outer sash guideways integral therewith; said outer sash guideways being spaced closer to each other than said inner sash guideways.

7. The window frame of claim 6 in which each of said vertical members has walls forming a channel extending into said window frame; each of said channels being spaced further from the interior of the window than from the outer side of the window; said upper and outer sash riding against the end of a channel wall; said lower and inner sash riding against the surface of said channel wall which extends normally to the surface against which said upper sash rides.

8. The window frame of claim 7 wherein each of said vertical members has a plurality of longitudinal fastening receiver channels forming fastener receiving members; said sill and header each having a substantially horizontal wall spaced from said sloping walls and at the periphery of said window frame, said sill and header further having means registering and cooperating with said fastener channels.

* * * * *